US005496212A

United States Patent [19]

Meyer-Weingartner et al.

[11] Patent Number: 5,496,212

[45] Date of Patent: Mar. 5, 1996

[54] COIN SORTING DEVICE

[75] Inventors: Heinz-Werner Meyer-Weingartner, Hollenbeck; Heinz Rehfinger, Kammerbusch, both of Germany

[73] Assignee: National Rejectors, Inc. Gmbh, Buxtehude, Germany

[21] Appl. No.: 226,757

[22] Filed: Apr. 12, 1994

[30] Foreign Application Priority Data

Apr. 24, 1993 [DE] Germany ..... 9306231 U

[51] Int. Cl.[6] ..... G07D 3/14

[52] U.S. Cl. ..... 453/4; 194/346

[58] Field of Search ..... 453/3, 4; 194/203, 194/346, 317

[56] References Cited

U.S. PATENT DOCUMENTS

| | | | |
|---|---|---|---|
| 3,401,780 | 9/1968 | Jullien-Davin . | |
| 3,653,481 | 4/1972 | Boxall et al. . | |
| 3,916,922 | 9/1976 | Gregory, Jr. . | |
| 3,978,962 | 11/1975 | Prümm | 133/3 R |
| 3,998,309 | 12/1976 | Mandas et al. | 194/97 R |
| 4,106,610 | 8/1978 | Heiman . | |
| 4,353,452 | 10/1982 | Shah et al. . | |
| 4,413,718 | 11/1983 | Dean . | |
| 4,546,868 | 10/1985 | Gregory, Jr. . | |
| 4,558,711 | 12/1985 | Yoshiaki et al. | 453/3 |
| 4,625,851 | 12/1986 | Johnson et al. | 194/200 |
| 4,650,057 | 3/1987 | Koester | 194/346 |
| 4,696,385 | 9/1987 | Davies | 194/319 |
| 4,971,188 | 11/1990 | Deters | 194/337 |
| 5,083,652 | 1/1992 | Kobayashi et al. | 194/318 |
| 5,131,518 | 5/1992 | Shimizu | 194/318 |
| 5,145,046 | 9/1992 | Satoh | 194/203 |
| 5,154,272 | 10/1992 | Nishiumi et al. | 194/318 |

FOREIGN PATENT DOCUMENTS

| | | | |
|---|---|---|---|
| 3718979 | 7/1989 | Germany | G07D 5/00 |
| 2121580 | 12/1983 | United Kingdom | 194/317 |

*Primary Examiner*—F. J. Bartuska

*Attorney, Agent, or Firm*—Senniger, Powers, Leavitt & Roedel

[57] ABSTRACT

A coin sorting device which sorts a plurality of coins as the coins pass through a coin chute. The coin sorter includes a coin flap located in the coin chute. A solenoid moves the coin flap between a first and second position. A power supply provides power to the solenoid. An emitter passes a beam of light through the coin chute across a path of the coin and through the coin flap. A detector detects the light emitted by the emitter after the light has passed through the coin chute and through the coin flap and produces an output signal as a function of the detected light. The output signal corresponds to the passage of the coin along the path and through the beam of light. A control circuit inhibits the power supply from providing power to the solenoid as a function of the output signal. Other coin flap and light barrier combinations are also disclosed.

30 Claims, 2 Drawing Sheets

COIN SORTING DEVICE

BACKGROUND OF THE INVENTION

Electronic coin validators are widely available for checking coins of different values. After validation, there is frequently a need to sort the coins in accordance with their value. This need is present :for example in vending machines which must be able to dispense change.

Various methods for sorting coins are known. One method is to guide falling coins along an inclined track in which one of several windows of different diameters are located and into which the coins fall in accordance with their size. Another method uses a deflection block with several deflection surfaces. When falling coins strike the block, the coins are guided in accordance with their width and diameter into different receiver conduits.

The use of shunts or flaps for sorting coins is also known. Such a flap sorting device is shown for example in German Application DE 37 18 979. The flaps are actuated by electromagnets which are driven by a suitable control devise in accordance with signals generated in the coin acceptor. Flaps permit a relatively high speed during coin sorting because the coins enter in free fall and are only slightly slowed down during their travel through the coin sorter. A disadvantage in such sorting devices can be the relatively large space requirement, especially if the flaps are to be arranged above each other in sequential order. A further disadvantage is the relatively large current requirement for the electromagnets, particularly in the case of battery-operated coin vending machines.

SUMMARY OF THE INVENTION

Among the objects of the present invention are to provide improved coin sorters which sort coins quickly and accurately; to provide improved coin sorters having multiple levels of sorting flaps; to provide improved coin sorters having an integrated light barrier for signalling the presence or absence of coins and the direction of travel of a coin; to provide improved coin sorters which require minimal electrical power to operate; to provide improved coin sorters which protect against stringing; to provide improved coin sorters which produce a credit signal when an authentic coin is properly sorted; and to provide improved coin sorters which are reliable, compact and economical.

Generally, one form of the invention is a coin sorter for sorting a plurality of coins as the coins pass through a coin chute. The coin sorter includes an upper coin flap located in the coin chute. Means moves the upper coin flap between a first and second position. A power supply provides power to the moving means. A lower coin flap is located in the coin chute downstream from the upper coin flap. An emitter passes a beam of light through the coin chute across a path of the coin and through the lower coin flap. A detector detects the light emitted by the emitter after the light has passed through the coin chute and through the lower coin flap and produces an output signal as a function of the detected light. The output signal corresponds to the passage of the coin. A control circuit inhibits the power supply from providing power to the moving means as a function of the output signal.

Generally, another form of the invention is a coin sorter for sorting a plurality of coins as the coins pass through a coin chute. The coin sorter includes a coin flap located in the coin chute. Means moves the coin flap between a first and second position. A power supply provides power to the moving means. An emitter passes a beam of light through the coin chute across a path of the coin and through the coin flap. A detector detects the light emitted by the emitter after the light has passed through the coin chute and through the coin flap and produces an output signal as a function of the detected light. The output signal corresponds to the passage of the coin along the path and through the beam of light. A control circuit inhibits the power supply from providing power to the moving means as a function of the output signal.

Generally, a still further form of the invention is a coin sorter for sorting a plurality of coins as the coins pass through a coin chute. The coin sorter includes an upper coin flap located in the coin chute and a lower coin flap located in the coin chute downstream from the upper coin flap. First means moves the upper coin flap between a first and second position. Second means moves the lower coin flap between a first and second position. A power supply provides power to the first and second moving means. An upper optical element produces a light barrier through the coin chute and produces a first output signal as a function of the passage of a coin through said barrier. A lower optical element produces a light barrier through the coin chute and produces a second output signal as a function of the passage of a coin through said barrier. The lower optical element is located downstream from the upper optical element. A control circuit inhibits the power supply from providing power to the first moving means as a function of the first output signal and inhibits the power supply from providing power to the second moving means as a function of the second output signal.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
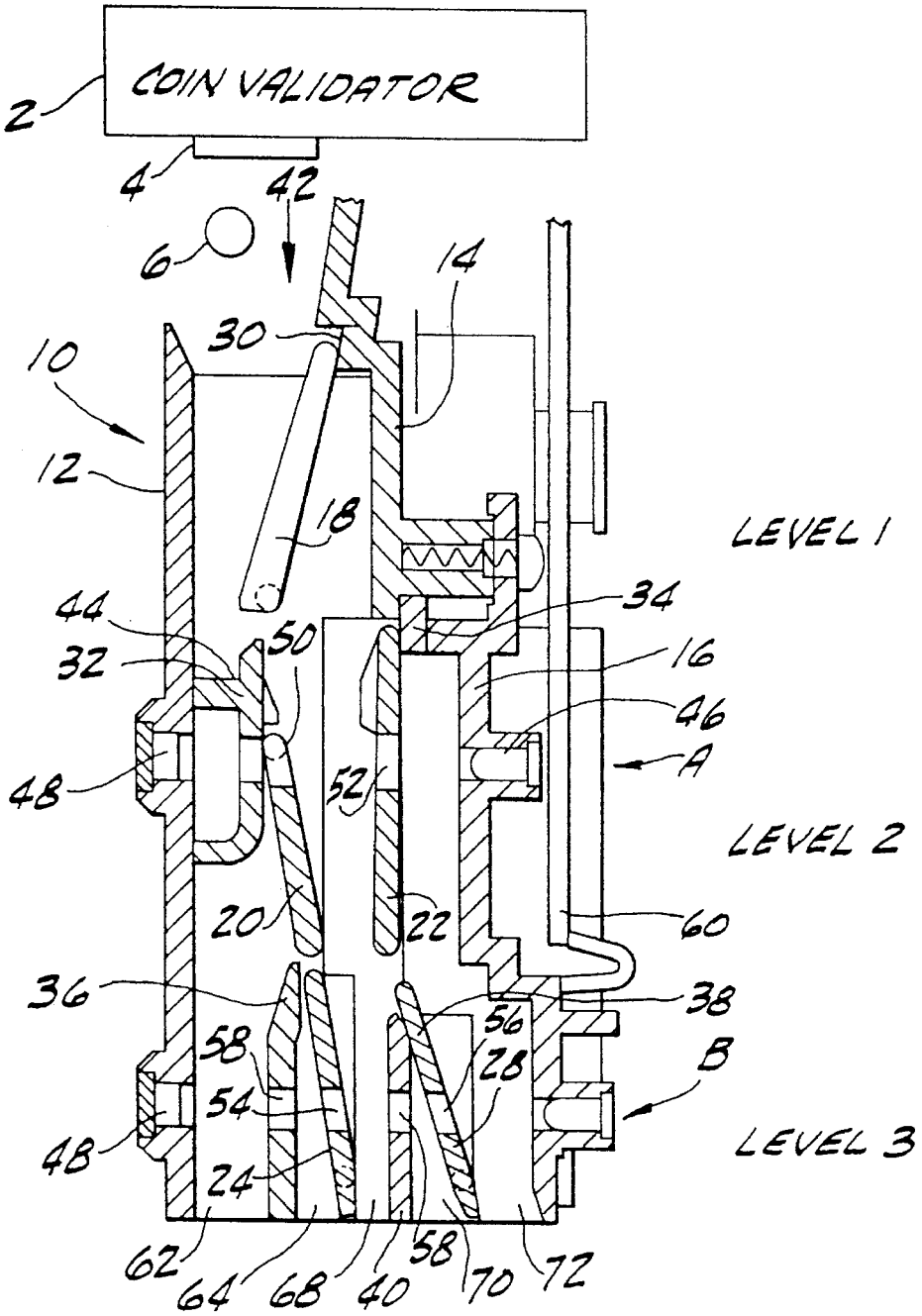
FIG. 1 shows a section through a sorting devise in accordance with the invention.

FIG. 1 shows a coin validator 2 in schematic form. Coin validator 2 may be any of the commonly found apparatus for validating coins, such as electric coils, light beams, mechanical testers, related control circuits, and the like. Coin validator 2 includes a coin slot 4 for supplying a coin 6 (coin 6 is shown 90 degrees out of position). A coin sorting device 10 is positioned downstream from coin validator 2 for sorting valid coins 6 and for returning to the user all slugs and any other objects not identified by coin validator 2 as valid coins.

Figure 4:
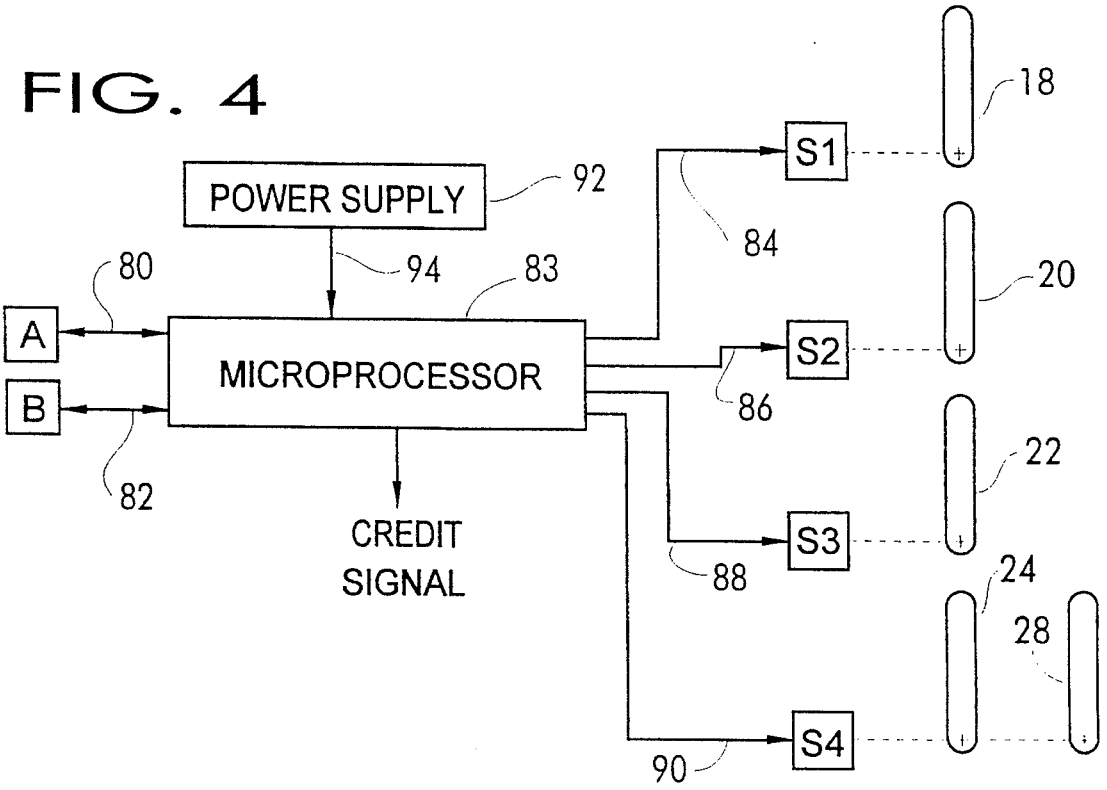
FIG. 4 is a schematic diagram of the electrical components for the sorting device of FIG. 1.

Sorting device 10 has two parallel plates 12 and 14 as well as a third plate 16 which follows plate 14. Flaps 18, 20, 22, 24 and 28 are pivotally mounted between the plates. The pivoting action takes place about an axis vertical to the plane of the drawing shown in FIG. 1. The pivoting axes are positioned at the lower end of flaps 18 to 28. Solenoids S1 to S4 shown in FIG. 4 are mechanically coupled to flaps 18 to 28 to move the flaps about their respective pivots. For example, solenoid S1 moves flap 18, solenoid S2 moves flap 20 and solenoid S3 moves flap 22. Flaps 24 and 28 are mechanically coupled to each other and are moved by a single solenoid S4.

Flaps 18 to 28 are shown in the rest position in FIG. 1 which is the position they are in when solenoids S1 to S4, respectively, are deenergized and consequently receive no electrical power. Solenoids S1 to S4 are preferably spring biased solenoids which include a spring for biasing the solenoids to position flaps 18 to 28 in the rest position during periods of time when the solenoids receive no electrical power. Flap 18, which is the receiving flap, is positioned at rest as shown in FIG. 1 with its upper end against stop 30 of plate 14. Flap 20 rests against a stop component 32 on plate 12. Flap 22 rests on a stop component 34 between plates 14 and 16. Flap 24 rests on a stop component 36. Flap 28 rests on a stop component 40. Solenoids S1 to S4 are coupled to flaps 18 to 28 for respectively rotating each flap away from said stops when the solenoids are energized with electrical power. In this way, the movement of flaps 18 to 28 provides alternate coin paths through sorting device 10 in order to accomplish the coin sorting function.

Figure 3:
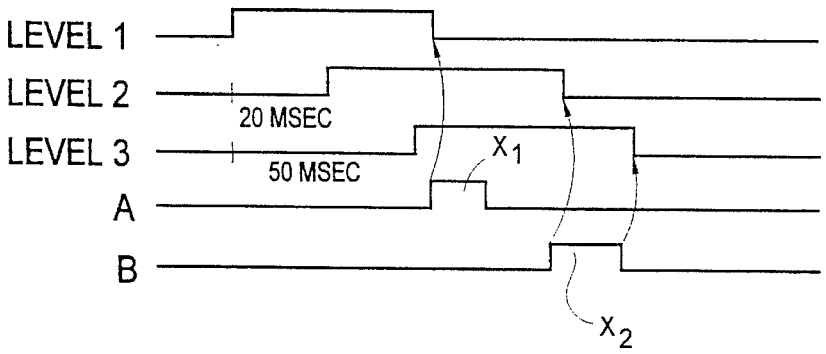
FIG. 3 shows a timing diagram of the switching impulses for the solenoids which control the coin flaps of the sorting device of FIG. 1.

As shown in FIG. 1, three levels of flaps are provided. Level one is the receiving level comprising flap 18. Coin 6 enters the receiving level under the force of gravity in the direction of arrow 42. When flap 18 is in the rest position, falling coins 6 are guided to a coin track 44 which further guides the coins to a coin return (not shown). Track 44 returns to the user all slugs and any other objects not identified by coin validator 2 as valid coins. When solenoid S1 is energized to move flap 18 to its other position, falling coins 6 are guided into the sorting mechanism for further sorting according to the value of each coin. Flaps 20 and 22 form level two and they are positioned with their axes at the same height. Accordingly, the same time control for level two shown in FIG. 3 is used for flaps 20 and 22. The axes of flaps 24 and 28 are also at the same height. Flaps 24 and 28 are mechanically coupled so that they move in unison in response to solenoid S4. Flaps 24 and 28 comprise level three.

Figure 2:
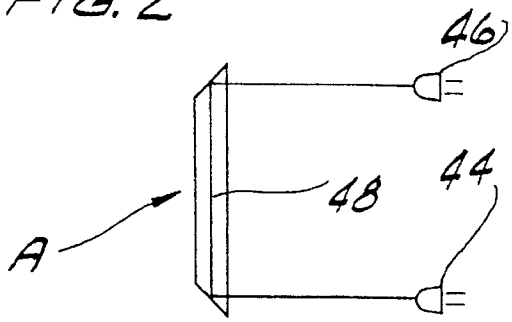
FIG. 2 schematically shows a light-barrier arrangement of the sorting device of FIG. 1.

Light barriers A and B are associated with the second and the third levels of flaps. FIG. 2 shows a schematic diagram of light barrier A. The schematic diagram of light barrier B is the same as that for light barrier A and therefore is not further described. Light barriers A and B consist of an optical transmitter element 44 and an optical receiver element 46, either or both of which may be soldered to a printed circuit board 60 attached to the outside of plate 16 in a suitable fashion. Alternatively, an opening or recess in plate 16 may be provided for each element 44 and 46. Light barriers A and B also include a deflection prism 48 in plate 12 which deflects the transmitted beam of transmitter element 44 through the body of the prism and back to receiver element 46. Receiver element 46 produces an output signal as a function of the light it detects.

Flap 20 has a recess 50 on its upper end and flap 22 has an opening 52 to let light from light barrier A pass through. Stop component 32 also has an opening to let light pass through. The optical axis of the light beam emitted by transmitter element 44 is aligned with recess 50 and opening 52 and with the opening in stop component 32 so that the light beam passes through flaps 20 and 22 without obstruction. As shown in FIG. 2, the light passes into prism 48, then through prism 48 to its other end, then back to receiver element 46. During the time when coin 6 passes by flaps 20 or 22, coin 6 obstructs the light beam being detected by receiver element 46. The output signal of receiving element 46 of light barrier A is shown in FIG. 3 as the signal identified as "A." The portion of signal A in the general form of a square wave identified as output signal $X_1$ indicates the change in the output signal caused by the passage of coin 6 through light barrier A. Accordingly, light barrier A detects the presence of a coin in the range of flaps 20 and 22.

Flaps 24 and 28 have openings 54 and 56 to allow light from light barrier B to pass through. Stop components 36 and 40 likewise have openings 58 to let light pass through. The optical axis of the light beam emitted by transmitter element 44 of light barrier B is aligned with openings 54 and 56 and with openings 58 so that the light beam passes through flaps 24 and 28 without obstruction. During the time when coin 6 passes by flaps 24 or 28, coin 6 obstructs the light beam being detected by receiver element 46. The output signal of receiving element 46 of light barrier B is shown in FIG. 3 as the signal identified as "B." The portion of signal B in the general form of a square wave identified as output signal $X_2$ indicates the change in the output signal caused by the passage of coin 6 through light barrier B. Accordingly, light barrier B detects the presence of a coin in the range of flaps 24 and 28.

Five exits 62, 64, 68, 70 and 72 are provided at the end of sorting device 10 which are aligned with the receiver shafts in a coin collector or safe (not shown) where the sorted coins are delivered and stored. Coin 6 entering in the direction of arrow 42 is therefore guided in accordance with its value and the position of flaps 20 to 28 to one of the exit openings 62 to 72.

FIG. 3 shows the timing organized by flap level for the energization of solenoids S1 to S4. Level one indicates the timing for the energization of solenoid S1 and the control of flap 18. Level two indicates the timing for the energization of solenoid S2 or S3 and the control of flap 20 or 22, respectively. Given the mechanical structure and geometry of sorting device 10 shown in FIG. 1, it will be noted that solenoids S2 and S3 are preferably energized alternatively depending on the value of the coin to be sorted. The value of coin 6 is determined from a credit signal produced by coin validator 2. By alternating energization of solenoids S2 and S3, the overall power requirements for sorting device 10 are reduced. Level three indicates the timing for the energization of solenoid S4 and the simultaneous control of flaps 24 and 28.

As shown in the timing diagram of FIG. 3, flaps 18 to 28 are operated successively in a time-sequenced manner. This decreases the power requirements of sorting device 10 and increases the rate at which coins 6 can be sorted. The chronological staggering is determined by the minimum time required for a coin to travel from a first flap to the next flap. In the present embodiment, a period of 20 msec preferably elapses from the actuation of flap 18 to the actuation of flap 20 or 22 and an additional 30 msec (for a total of 50 msec) elapses until the actuation of flaps 24 and 28.

Output signals $X_1$ and $X_2$ as shown in FIG. 3 indicate the entering and exiting of a coin into light barriers A and B, respectively. Solenoid S1 for flap 18 is deenergized when the coin enters into light barrier A, as indicated by the leading edge of output signal $X_1$. Solenoid S2 or S3 for flap 20 or 22 is deenergized when the coin enters into light barrier B, as indicated by the leading edge of output signal $X_2$. Solenoid S4 for flaps 24 and 28 is deenergized when the coin leaves light barrier B, as indicated by the trailing edge of output signal $X_2$.

As determined by the timing shown in FIG. 3, flaps 18 to 28 remain in the operating position with their respective solenoids energized only as long as is required for the operation of the sorting device. As seen in FIG. 1, sufficient space is provided below the point of contact between the broad face of flaps 18 to 28 when each is in the rest position and the respective plate 12, 14 or 16 and/or stop component 30, 32, 34, 36 or 40 against which the respective flap rests so that a coin which is located in the area of the particular flap is not clamped in position when the flap returns to its rest position. This space is preferably greater than the thickness of the thickest coin to be sorted by sorting device 10. As soon as the upper edge of the coin passing through has left the stop area, the flap is returned to the rest position without any risk that the coin might be clamped in position by the flap. The returning of the flap to its rest position can therefore begin while the coin is still partly located in the area of the associated flap.

Accordingly, flaps 18 to 28 of sorting device 10 are arranged very close together in the three identified levels. The arrangement of light barriers A and B in the area of the flaps and the corresponding openings and recesses allows for the detection of coins 6 as they pass through the flaps. As a result, a new actuating signal is generated for the flap arranged above the light barrier, so that the latter is moved back into the rest position and the respective solenoid is electrically switched off earlier in time. As seen with flaps 24 and 28, the detection of coin 6 leaving light barrier B also allows for the early return of these flaps to the rest position and to the prompt switching off of solenoid S4. The rapid return of the flaps to the rest position renders the sorting devise operationally ready for the insertion of a following coin. The coins can therefore be inserted one after the other in a rapid sequence. In a coin acceptor with a sorting device, the latter normally determines the acceptable frequency of insertion. Further, the earlier deenergization of the solenoids reduces the electrical power requirements of the coin sorting device 10.

FIG. 4 is a schematic diagram of the electrical components for sorting device 10. Any other circuit components which achieve similar operation may also be used. The blocks identified as "A" and "B" in FIG. 4 schematically represent the light barriers A and B which are more fully shown in FIG. 2. Transmitter element 44 and receiver element 46 of light barrier A are connected via a line 80 to a microprocessor 83 in FIG. 4. Likewise, transmitter element 44 and receiver element 46 of light barrier B are connected via a line 82 to microprocessor 83. In practice, microprocessor 83 is preferably the same microprocessor as used to control coin validator 2 in FIG. 1.

Microprocessor 83 controls solenoids S1 to S4 via lines 84, 86, 88 and 90, respectively, to thereby control flaps 18 to 28 which are coupled to solenoids S1 to S4. A power supply 92, such as a battery or wall outlet, provides power via a line 94 to solenoids S1 to S4. Microprocessor 83 controls solenoids S1 to S4 by inhibiting or allowing each of them to receive electrical power. This is preferably accomplished with an electrical switch (not shown) commonly found within microprocessor 83.

In use, microprocessor 83 receives a credit signal from coin validator 2 identifying coin 6 as an authentic coin of a given value. Microprocessor 83 responds by determining which coin exit (62, 64, 68, 70 or 72) coin 6 should pass through and by determining the positions of the coin flaps (18 to 28) needed to select the coin exit. Microprocessor 83 then sequentially energizes solenoids S1 to S4 with electrical power according to the timing sequence shown in FIG. 3 in order to properly position the coin flaps to output the falling coin through the proper coin exit.

For example, microprocessor positions flap 18 first by suitably controlling the flow of electrical power to solenoid S1. A timer (not shown) internal to microprocessor 83 then clocks out approximately 20 msec whereafter microprocessor 83 responds by positioning flap 20 or 22 through control of solenoids S2 and S3. The timer then clocks out approximately 30 msec whereafter microprocessor 83 responds by positioning flaps 24 and 28 through control of solenoid S4. As microprocessor 83 receives output signals $X_1$ and $X_2$ from light barriers A and B, respectively, microprocessor 83 turns off the respective solenoids according to the timing sequence shown in FIG. 3. For example, microprocessor 83 inhibits flow of power to solenoid S1 at the leading edge of output signal $X_1$, to solenoids S2 and S3 at the leading edge of output signal $X_2$, and to solenoid S4 at the trailing edge of output signal $X_2$. Microprocessor 83 then checks to insure that it received output signal $X_1$ before it received output signal $X_2$ and, if so, microprocessor 83 outputs the credit signal for the value of the sorted coin. If output signals $X_1$ and $X_2$ are received in the reverse order, the credit signal is cancelled for the coin as described below. Likewise, if microprocessor 83 does not receive both of output signals $X_1$ and $X_2$, then the credit signal for the coin is also cancelled.

Other timing sequences than that shown in FIG. 3 can also be used. For example, the delays of 20 and 50 msec can be changed to accomodate the particular fall times of the coins 6 as they pass through sorting device 10. Likewise, output signals $X_1$ and $X_2$ can be used to control solenoids S1 to S4 in any desired order. For example, microprocessor 83 can inhibit the power to solenoid S1 at the leading edge of output signal $X_1$, to solenoids S2 and S3 at the trailing edge of output signal $X_1$, and to solenoid S4 at the leading or trailing edge of output signal $X_2$. Likewise, microprocessor 83 can separately control solenoids S2 and S3 based on different edges of output signals $X_1$ and $X_2$. Still other timing sequences can also be used depending on the requirements of the particular application.

Constant attempts are made to trick coin acceptors and sorting devices to dispense goods or services without payment. One way, for example, is to suspend a genuine coin on a thread and to allow the coin to run through the coin acceptor and subsequently through the sorting devise and then to retrieve the coin or to generate another credit signal. As a precaution against stringing, microprocessor 83 preferably monitors the sequence of output signals $X_1$ and $X_2$. If output signal $X_2$ appears before output signal $X_1$, this indicates that the coin is travelling in the reverse direction, presumably because the user is attempting to improperly remove a coin or receive a credit. In this event, microprocessor 83 cancels the credit signal and prevents a purchase procedure or the like until proper credit is established. Likewise, microprocessor 83 cancels the credit signal if it does not receive both of output signals $X_1$ and $X_2$. For the circumstance where output signal $X_1$ precedes output signal $X_2$, microprocessor 83 outputs the credit signal which credits the user with the value of the sorted coin.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A coin sorting device for sorting a plurality of coins as the coins pass through a coin chute, the device comprising:

an upper coin flap located in the coin chute, the upper coin flap being movable between a first position and a second position;

means for moving the upper coin flap between the first and the second positions;

a lower coin flap located in the coin chute downstream from the upper coin flap;

an emitter for passing a beam of light through the coin chute across a path of the coin and through the lower coin flap; wherein the lower coin flax is movable relative to the beam of light;

a detector for detecting the light emitted by the emitter after the light has passed through the coin chute and through the lower coin flap and for producing an output signal representative of the detected light, said output signal corresponding to the passage of the coin along the path and through the beam of light; and a power supply for intermittently providing power to the means for moving the upper coin flap and including a control circuit responsive to the detector for inhibiting the power supply from providing power to the means for moving the upper coin flap as a function of the output signal representative of the light passing through the lower coin flap, whereby the amount of power used by the means for moving the upper coin flap during operation of the coin sorting device is reduced.

2. The coin sorting device of claim 1 wherein the means for moving the upper coin flap further comprises a solenoid coupled to the upper coin flap for moving said flap between the first and the second positions.

3. The coin sorting device of claim 2 wherein the solenoid further comprises a spring-biased solenoid for biasing the solenoid to position the upper coin flap in the first position during periods of time when the control circuit inhibits the power supply from providing power to the means for moving the upper coin flap.

4. The coin sorting device of claim 1 further comprising means for moving the lower coin flap between a first position and a second position;

wherein the output signal has a leading edge and a trailing edge; and wherein the control circuit inhibits the power supply from providing power to the means for moving the upper coin flap in response to the leading edge and inhibits the power supply from providing power to the means for moving the lower coin flap in response to the trailing edge.

5. The coin sorting device of claim 1 wherein the lower coin flap defines an opening or recess for allowing the beam of light from the emitter to pass through the lower coin flap and for allowing the detector to detect the beam of light.

6. The coin sorting device of claim 1 further comprising a stop; wherein the upper coin flap rests in the first position against the stop; and wherein a space below a point of contact between the upper coin flap in the first position and the stop is greater than the thickness of the thickest coin to be sorted by the coin sorting device.

7. The coin sorting device of claim 1 further comprising a timer and means for moving the lower coin flap between a first position and a second position, said timer actuating said means for moving the lower coin flap after actuation of the means for moving the upper coin flap, whereby the means for moving the upper coin flap moves the upper coin flap prior to the time when the means for moving the lower coin flap moves the lower coin flap during the operation of the coin sorting device in sorting the coin.

8. The coin sorting device of claim 1 further comprising:

a coin validator upstream from the coin chute for delivering the coin to the chute and for producing a credit signal as a function of the value of the coin;

a second emitter for passing a second beam of light through the coin chute across a path of the coin; and a second detector for detecting the light emitted by the second emitter after the light has passed through the coin chute and for producing a second output signal as a function of the detected light which second output signal corresponds to the passage of a coin through the second beam of light;

wherein the second emitter and the second detector are located along the coin chute downstream from the first mentioned emitter; and wherein the control circuit is responsive to the coin validator for outputting the credit signal as a function of the second output signal occurring before the first output signal, whereby a user of the coin sorting device receives a credit for the value of each coin properly deposited into the coin sorting device by the user.

9. The coin sorting device of claim 1 further comprising a coin validator upstream from the coin chute for delivering the coin to the coin chute and for producing a credit signal as a function of the value of the coin;

wherein the control circuit is responsive to the coin validator and the detector for outputting the credit signal as a function of whether the detector produces the output signal for the delivered coin, whereby a user of the coin sorting device thereby receives a credit for the value of each coin properly deposited into the coin sorting device by the user.

10. The coin sorting device of claim 1 wherein the power supply comprises a battery.

11. A coin sorting device for sorting a plurality of coins as the coins pass through a coin chute, the device comprising:

a coin flap located in the coin chute, the coin flap being movable between a first position and a second position;

means for moving the coin flap between the first and the second positions;

an emitter for passing a beam of light through the coin chute across a path of the coin and through the coin flap; wherein the coin flap is movable relative to the beam of light;

a detector for detecting the light emitted by the emitter after the light has passed through the coin chute and through the coin flap and for producing an output signal representative of the detected light, said output signal corresponding to the passage of the coin along the path and through the beam of light; and a power supply for intermittently providing power to the means for moving the coin flap and including a control circuit responsive to the detector for inhibiting the power supply from providing power to the means for moving the coin flap as a function of the output signal representative of the light passing through the coin flap, whereby the amount of power used by the means for moving the coin flap during operation of the coin sorting device is reduced.

12. The coin sorting device of claim 11 wherein the means for moving the coin flap further comprises a solenoid coupled to the coin flap for moving said flap between the first and the second positions.

13. The coin sorting device of claim 12 wherein the solenoid further comprises a spring-biased solenoid for biasing the solenoid to position the coin flap in the first position during periods of time when the control circuit inhibits the power supply from providing power to the means for moving the coin flap.

14. The coin sorting device of claim 11 further comprising:

a lower coin flap located in the coin chute downstream from the first mentioned coin flap; and means for moving the lower coin flap between a first position and a second position;

wherein the output signal has a leading edge and a trailing edge; and wherein the control circuit inhibits the power supply from providing power to the means for moving the first mentioned coin flap in response to the leading edge and inhibits the power supply from providing power to the means for moving the lower coin flap in response to the trailing edge.

15. The coin sorting device of claim 11 wherein the coin flap defines an opening or recess for allowing the beam of light from the emitter to pass through the coin flap and for allowing the detector to detect the beam of light.

16. The coin sorting device of claim 11 further comprising a stop; wherein the coin flap rests in the first position against the stop; and wherein a space below a point of contact between the coin flap in the first position and the stop is greater than the thickness of the thickest coin to be sorted by the coin sorting device.

17. The coin sorting device of claim 11 further comprising:

a timer;

a lower coin flap located in the coin chute downstream from the first mentioned coin flap; and means for moving the lower coin flap between a first position and a second position, said timer actuating said means for moving the lower coin flap after actuation of the means for moving the first mentioned coin flap, whereby the means for moving the first mentioned coin flap moves the first mentioned coin flap prior to the time when the means for moving the lower coin flap moves the lower coin flap during the operation of the coin sorting device in sorting the coin.

18. The coin sorting device of claim 11 further comprising:

a coin validator upstream from the coin chute for delivering the coin to the chute and for producing a credit signal as a function of the value of the coin;

a second emitter for passing a second beam of light through the coin chute across a path of the coin; and a second detector for detecting the light emitted by the second emitter after the light has passed through the coin chute and for producing a second output signal as a function of the detected light which second output signal corresponds to the passage of a coin through the second beam of light;

wherein the second emitter and the second detector are located along the coin chute downstream from the coin flap; and wherein the control circuit is responsive to the coin validator for outputting the credit signal as a function of the second output signal occurring before the first mentioned output signal, whereby a user of the coin sorting device receives a credit for the value of each coin properly deposited into the coin sorting device by the user.

19. The coin sorting device of claim 11 further comprising a coin validator upstream from the coin chute for delivering the coin to the coin chute and for producing a credit signal as a function of the value of the coin;

wherein the control circuit is responsive to the coin validator and the detector for outputting the credit signal as a function of whether the detector produces the output signal whereby a user of the coin sorting device receives a credit for the value of each coin properly deposited into the coin sorting device by the user.

20. The coin sorting device of claim 11 wherein the power supply comprises a battery.

21. A coin sorting device for sorting a plurality of coins as the coins pass through a coin chute, the device comprising:

an upper stop;

an upper coin flap located in the coin chute, the upper coin flap being movable between a first position and a second position;

wherein the upper coin flap rests in the first position against the upper stop and wherein a space below a point of contact between the upper coin flap in the first position and the upper stop is greater than the thickness of the thickest coin to be sorted by the coin sorting device;

a lower stop;

a lower coin flap located in the coin chute downstream from the upper coin flap, the lower coin flap being movable between a first position and a second position;

wherein the lower coin flap rests in the first position against the lower stop and wherein a space below a point of contact between the lower coin flap in the first position and the lower stop is greater than the thickness of the thickest coin to be sorted by the coin sorting device;

means for moving the upper coin flap between the first and the second positions;

means for moving the lower coin flap between the first and the second positions;

a battery for providing power to said means for moving the upper and lower coin flaps;

an upper optical element for producing a light barrier through the coin chute and for producing a first output signal as a function of the passage of a coin through said barrier;

a lower optical element for producing a light barrier through the coin chute and for producing a second output signal as a function of the passage of a coin through said barrier, said lower optical element being located downstream from said upper optical element; and a control circuit responsive to the upper and lower optical elements for inhibiting the battery from providing power to the means for moving the upper coin flap as a function of the first output signal and for inhibiting the battery from providing power to the means for moving the lower coin flap as a function of the second output signal, whereby the amount of power used by said means for moving the upper and lower coin flaps during operation of the coin sorting device is reduced.

22. The coin sorting device of claim 21 wherein the means for moving the upper coin flap further comprises a first solenoid coupled to the upper coin flap for moving said flap between the first and the second positions and wherein the means for moving the lower coin flap further comprises a second solenoid coupled to the lower coin flap for moving said flap between the first and the second positions.

23. The coin sorting device of claim 22 wherein each of the first and the second solenoids further comprises a spring-biased solenoid for biasing the solenoid; wherein the first solenoid positions the upper coin flap in the first position during periods of time when the control circuit inhibits the power supply from providing power to the means for moving the upper coin flap; and wherein the second solenoid positions the lower coin flap in the first position during periods of time when the control circuit inhibits the power supply from providing power to the means for moving the lower coin flap.

24. The coin sorting device of claim 21 further comprising:

a middle coin flap located in the coin chute downstream from the upper coin flap and upstream from the lower coin flap, the middle coin flap being movable between a first position and a second position; and means for moving the middle coin flap between the first and the second positions;

wherein the second output signal has a leading edge and a trailing edge; and wherein the control circuit inhibits the power supply from providing power to the means for moving the upper coin flap in response to the first output signal, inhibits the power supply from providing power to the means for moving the middle coin flap in response to the leading edge, and inhibits the power supply from providing power to the means for moving the lower coin flap in response to the trailing edge.

25. The coin sorting device of claim 21 further comprising:

a middle coin flap located in the coin chute downstream from the upper coin flap and upstream from the lower coin flap, the middle coin flap being movable between a first position and a second position; and means for moving the middle coin flap between the first and the second positions;

wherein the first output signal has a leading edge and a trailing edge;

wherein the control circuit inhibits the power supply from providing power to the means for moving the upper coin flap in response to the leading edge, inhibits the power supply from providing power to the means for moving the middle coin flap in response to the trailing edge, and inhibits the power supply from providing power to the means for moving the lower coin flap in response to the second output signal.

26. The coin sorting device of claim 21 wherein the upper optical element comprises an emitter for passing a beam of light through the coin chute across a path of the coin and a detector for detecting the beam of light; and wherein the upper coin flap defines an opening or recess for allowing the beam of light from the emitter to pass through the upper coin flap and for allowing the detector to detect the beam of light.

27. The coin sorting device of claim 21 further comprising a timer, said timer actuating said means for moving the lower coin flap after actuation of the means for moving the upper coin flap, whereby the means for moving the upper coin flap moves the upper coin flap prior to a time when the means for moving the lower coin flap moves the lower coin flap during the operation of the coin sorting device in sorting the coin.

28. The coin sorting device of claim 21 further comprising:

a coin validator upstream from the coin chute for delivering the coin to the chute and for producing a credit signal as a function of the value of the coin;

wherein the control circuit is responsive to the coin validator for outputting the credit signal as a function of the second output signal occurring before the first output signal, whereby a user of the coin sorting device receives a credit for the value of each coin properly deposited into the coin sorting device by the user.

29. The coin sorting device of claim 21 further comprising a coin validator upstream from the coin chute for delivering the coin to the coin chute and for producing a credit signal as a function of the value of the coin;

wherein the control circuit is responsive to the coin validator and the lower optical element for outputting the credit signal as a function of whether the lower optical element produces the second output signal for the delivered coin, whereby a user of the coin sorting device receives a credit for the value of each coin properly deposited into the coin sorting device by the user.

30. A coin sorting device for sorting a plurality of coins as the coins pass through a coin chute, the device comprising:

an upper coin flap located in the coin chute, the upper coin flap being movable between a first position and a second position;

means for moving the upper coin flap between the first and the second positions;

a lower coin flap located in the coin chute downstream from the upper coin flap, the lower coin flap being movable between a first position and a second position;

means for moving the lower coin flap between the first and the second positions;

an emitter for passing a beam of light through the coin chute across a path of the coin;

a detector for detecting the light emitted by the emitter after the light has passed through the coin chute and for producing an output signal representative of the detected light;

wherein the output signal corresponds to the passage of the coin along the path and through the beam of light and wherein the output signal has a leading edge and a trailing edge;

a power supply for intermittently providing power to the means for moving the upper coin flap and to the means for moving the lower coin flap; wherein the power supply further comprises a control circuit responsive to the detector for inhibiting the power supply from providing power to the means for moving the upper coin flap in response to the leading edge and for inhibiting the power supply from providing power to the means for moving the lower coin flap in response to the trailing edge, whereby the amount of power used by the means for moving the upper coin flap and the means for moving the lower coin flap during operation of the coin sorting device is reduced.

* * * * *